United States Patent [19]

Addison, Jr.

[11] Patent Number: 4,762,340

[45] Date of Patent: Aug. 9, 1988

[54] TIMING DEVICE FOR SKIERS

[76] Inventor: Oswald G. Addison, Jr., 6809 Nashville Rd., Lanham, Md. 20706

[21] Appl. No.: 923,139

[22] Filed: Oct. 24, 1986

[51] Int. Cl.[4] ..... A63C 11/22

[52] U.S. Cl. ..... 280/816; 280/821; 368/278

[58] Field of Search ..... 280/816, 819, 821; 368/10, 278; 135/66

[56] References Cited

U.S. PATENT DOCUMENTS 4,082,302 4/1978 Albrecht ..... 280/816

4,111,444 9/1978 Clements ..... 280/816

FOREIGN PATENT DOCUMENTS 2578074 8/1986 France ..... 280/821

*Primary Examiner*—David M. Mitchell

*Attorney, Agent, or Firm*—Millen & White

[57] ABSTRACT

A ski pole having a handle on which a liquid crystal display chronometer is detachably mounted. The liquid crystal display chronometer is mounted by means of inserting the chronometer inside the handle of the ski pole which is held in place by a lens and four set screws and so arranged that the push button is located as to be actuable by the thumb of the skier.

4 Claims, 1 Drawing Sheet

TIMING DEVICE FOR SKIERS

BACKGROUND OF THE INVENTION

The present invention relates to a ski pole having a watch incorporated therein, which the watch is removably mounted in the handle of the ski pole.

With a conventional stopwatch a person is unable to control his traveling time accurately, since simultaneously actuating a stopwatch and pushing off with the ski poles is not possible. Moreover, it is possible only with considerable difficulty, if not impossible, to check the time of a certain section of a run during travel along a downhill run and this generally necessitates an assistant. It is readily seen that with the proposed combination of a watch and stopwatch with a ski pole the time of day and a time check of any segment of the downhill run is possible.

SUMMARY OF THE INVENTION

According to the present invention there is provided a ski pole having a handle, in combination with a chronometer, the chronometer being detachably secured in the handle of the ski pole.

Preferably, the chronometer has a housing which is detachably connectable to the handle by means of a lens and four set screws.

BRIEF DESCRIPTION OF THE DRAWING

An embodiment of the invention is described below by way of example, with reference to the accompanying drawings, in which.

DETAILED DESCRIPTION

Figure 1:
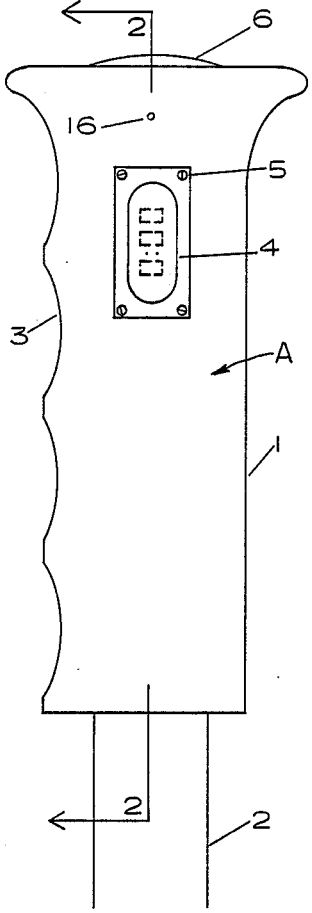
FIG. 1. shows the ski pole handle, the push button and the lens and four set screws.

FIG. 1 shows a handle 1 of a ski pole which only a portion 2 is shown and the handle 1 has a watch/stopwatch removably located therein by means of a lens 4 and four set screws 5. The push button 6 is so arranged that the stopwatch can be actuated by the thumb. The ski pole preferably has four finger grip portions 3. In the present embodiment the handle 1 is extruded from a plastic material composition.

Figure 2:
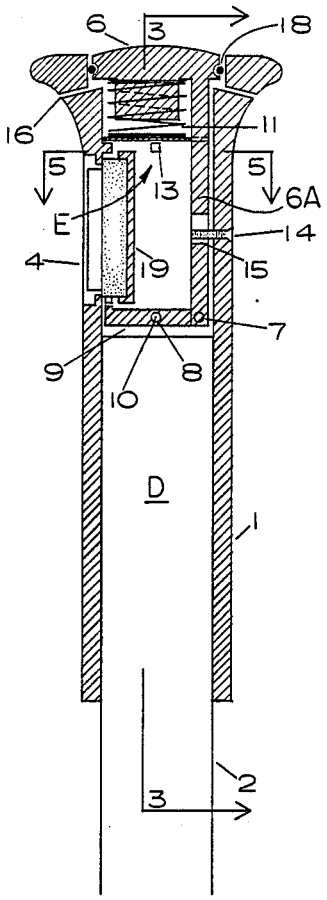
FIG. 2. shows a cross sectional view of FIG. 1 along line 2—2.

FIG. 2 is a cross sectional view of the ski pole 2 handle 1. The push button assembly 6 therein is actuated by the downward push of the thumb. The two pivot points 7 and 8 thereon causes the lever 9 to rotate upward by means of the metal pivot pin 10 therein depressing the button on the stopwatch. The spring 11 therein moves the push button assembly 6 back to the start position and is mounted on the o-ring 12 which is supported by three supports 13 that are positioned on the inside wall of the handle 1. The watch/stopwatch is held in place by a bracket 19.

Figure 3:
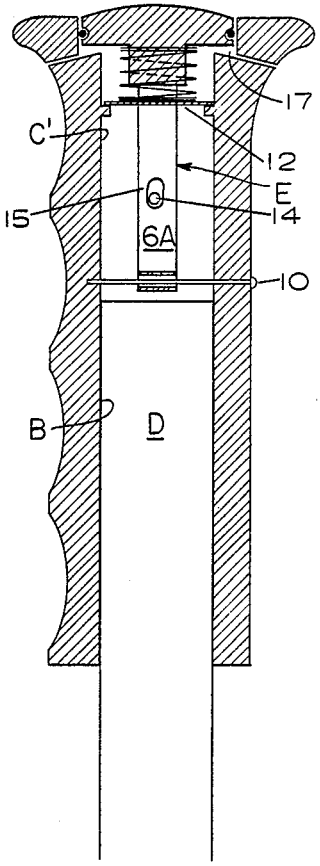
FIG. 3. shows a longitudinal section of FIG. 2 along line 3—3.
Figure 4:
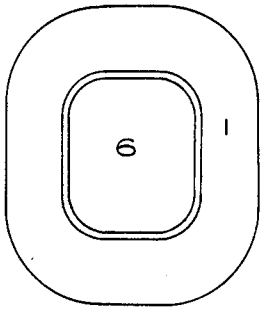
FIG. 4. shows a plan view of the ski pole handle.
Figure 5:
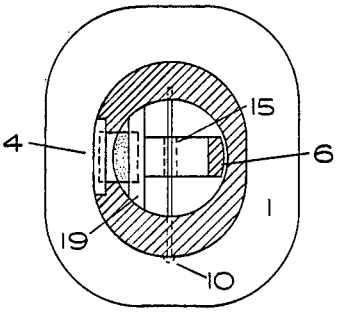
FIG. 5. shows a cross sectional plan view of FIG. 2 along line 5—5.

FIG. 3 is a longitudinal sectional of the handle 1 showing the metal retainer screw 14 which is inserted through the wall of the handle 1 and through the retainer slot 15 therein the push button assembly 6 which holds the push button assembly 6 in place ready to be actuated again. The weep holes 16 which are positioned around the top portion of the handle 1 will drain off any water or moisture that may collect in the drain ridge 17 which may seep between the water resistant rubber gasket 18 and the push button 6.

Considering the invention more specifically, it is seen that the grip, designated generally by the letter A, has a bore therein comprised of a first portion B and a second portion C. The first portion B receives the top of a ski pole D therein while the second portion C receives the timer and operating mechanism designated generally the the letter E consisting of the watch/stopwatch 4, the push button 6 and the linkage from the push button 6 to the watch/stopwatch.

The push button 6 has a stem 6A depending therefrom which operates the bell crank lever 9 and restricts projection of the push button in a first axial direction out of the grip A and in a second axial direction into the grip. The spring 11 bearing against the fixed surface 13 urges the push button 6 in the first axial direction and pressure on the push button against the bias of the spring urges the push button in the second axial direction whereupon it operates the bellcrank lever 9.

The weep holes 16 are positioned in alignment with a shoulder H behind the lower surface of the push button, which shoulder slopes obliquely with respect to the axis of the grip and downwardly in the direction of the second portion of the grip.

I claim:

1. In combination with the grip of a ski pole having a bore therethrough a first portion of which receives a top of a ski pole and a second portion of which extends above the top of the ski pole when the ski pole is inserted into the first portion; a timing device within the second portion, the improvement comprising:

an opening through the top of the grip and communicating with the second portion of the bore;

a push button slidably received in the opening and having a face exposed at the top of the grip;

a stem attached to the push button and projecting down into the second portion of the grip;

a pin-in-slot connection coupling the stem to the wall of the second portion of the bore so as to allow the push button limited movement in the first and second axial directions;

a fixed surface in the second portion of the bore;

spring means disposed between the fixed surface and the push button for urging the push button in the first axial direction;

a timer in the grip, the timer having a face with timing indicia exposed for viewing external to the grip;

acctivating means linking the stem to the timing means for operating the timing means upon pushing the push button in the second direction against the bias of the spring means;

sealing means between the push button and the inner wall of the bore for minimizing entry of moisture into the bore which moisture might interfere with operation of the push button or timer should the moisture accumulate within the bore; and weep hole means extending through the grip from the second portion thereof to a point open to the atmosphere to allow moisture which may have entered the second portion of the bore to escape.

2. The combination of claim 1 wherein there is a shoulder within the second portion of the bore positioned behind the push button which shoulder is aligned with the weep hole means.

3. The combination of claim 2 wherein the shoulder has a surface obliquely oriented with respect to the axis of the grip and sloping downwardly in a direction toward the first portion of the grip.

4. The combination of claim 1 wherein the activating means includes a bell crank pivoted within the bore, the bell crank having one end pivoted to the end of the stem and the other in engagement with an operating button on the timer.

* * * * *